US006680451B1

(12) United States Patent
Miller

(10) Patent No.: US 6,680,451 B1
(45) Date of Patent: Jan. 20, 2004

(54) METHOD AND APPARATUS FOR ELECTRICALLY CHARGING AND SEPARATING PARTICLES

(76) Inventor: Charles O. Miller, 10162 N. 103rd St., Scottsdale, AZ (US) 85258

( * ) Notice: Subject to any disclaimer, the term of this patent is extended or adjusted under 35 U.S.C. 154(b) by 0 days.

(21) Appl. No.: 09/572,702

(22) Filed: May 16, 2000

Related U.S. Application Data

(63) Continuation-in-part of application No. 09/021,431, filed on Feb. 10, 1998, now Pat. No. 6,072,140.

(51) Int. Cl.[7] ..... B03C 7/08
(52) U.S. Cl. ..... 209/129
(58) Field of Search ..... 209/127.1, 127.4, 209/128, 129

(56) References Cited

U.S. PATENT DOCUMENTS

| | | | | | |
|---|---|---|---|---|---|
| 865,711 | A | * | 9/1907 | Kitsee | 209/129 |
| 2,187,637 | A | * | 1/1940 | Sutton et al. | 209/129 |
| 2,328,577 | A | * | 9/1943 | Oglesby | 51/295 |
| 2,889,042 | A | * | 6/1959 | Baron | 209/127.1 |
| 4,174,030 | A | * | 11/1979 | Philibert | 198/494 |
| 4,247,390 | A | * | 1/1981 | Knoll | 209/129 |
| 4,282,303 | A | * | 8/1981 | Bergen | 430/120 |
| 4,289,837 | A | * | 9/1981 | Gundlach | 430/39 |
| 5,735,402 | A | * | 4/1998 | Pezzoli et al. | 209/129 |
| 6,467,628 | B1 | * | 10/2002 | Maehata et al. | 209/12.2 |

FOREIGN PATENT DOCUMENTS

| | | | | |
|---|---|---|---|---|
| SU | 1297913 | * | 3/1987 | 209/129 |
| SU | 1472128 | * | 4/1989 | 209/129 |

* cited by examiner

*Primary Examiner*—Donald P. Walsh
*Assistant Examiner*—Daniel Schlak
(74) *Attorney, Agent, or Firm*—Tod R. Nissle, P.C.

(57) ABSTRACT

A method is provided for separating particles having different triboelectric propensities. The method utilizes a voltage of less than five volts electrically charge a surface and to reduce the risk of fires and explosions that are associated with particle treatment facilities. The method charges a surface and the surface is used to attract particles. The method does not focus on charging particles. The method also utilizes apparatus in which the electric charge is frictionally produced by a member positioned on the inside of the apparatus.

3 Claims, 3 Drawing Sheets

FIG. 1 (Prior Art)
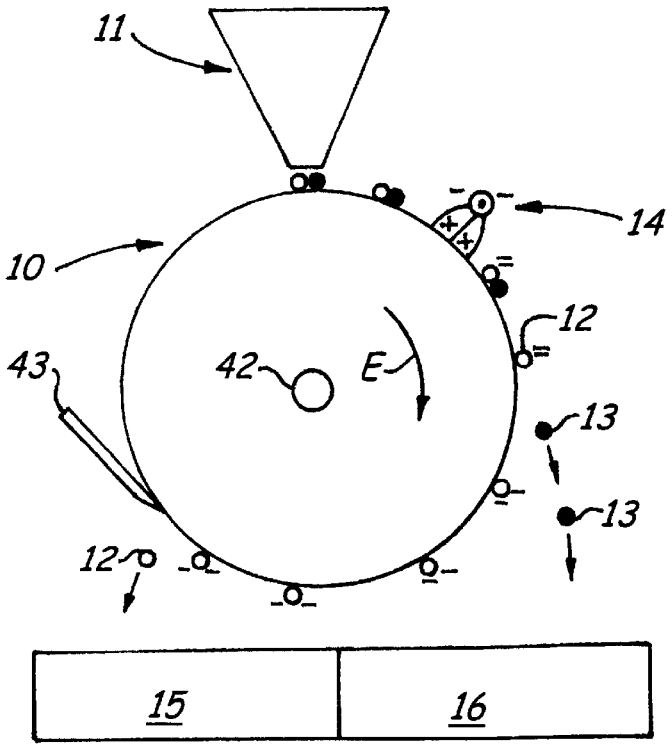
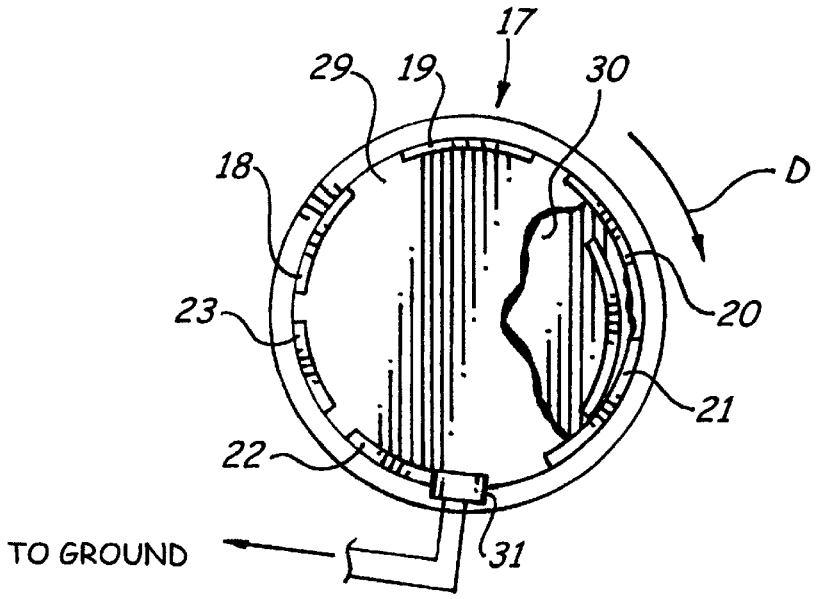
FIG. 3

METHOD AND APPARATUS FOR ELECTRICALLY CHARGING AND SEPARATING PARTICLES

This application is a continuation-in-part of application Ser. No. 09/021,431, filed Feb. 10, 1998, now U.S. Pat. No. 6,072,140, issued Jun. 6, 2002.

BACKGROUND OF THE INVENTION

1. Field of the Invention.

This invention pertains to a particle separation method and apparatus.

More particularly, the invention relates to an apparatus and method for separating dielectric particles.

In a further respect, the invention relates to a particle separation apparatus and method which reduce the risk that a fire or explosion will occur during the separation of particulate.

In another respect, the invention relates to a particle separation apparatus and method which facilitates the separation of elongate fiber strands from a plurality of small substantially round particles.

2. Description of the Related Art including information disclosed under 37 C.F.R. 1.97 and 1.98.

A wide variety of particle separation apparatus is apparently known in the art. One such particle separation apparatus is illustrated in FIG. 1 and includes a cylindrical steel roller 10 which rotates in the direction of arrow E about axle 42. A hopper 11 feeds a mixture of electrically non-conductive 12 and electrically conductive particles 13 onto the cylindrical outer surface or roller 10. The size of the particles is greatly exaggerated for purposes of clarity. The positive side of the power supply is connected to the roller 10. The roller 10 is grounded. An elongate wire 14 is spaced apart from and parallel to the cylindrical surface of roller 10. The wire 14 serves as the negative electrode. A large voltage is directed through wire 14 to produce a corona around the wire. Negative ions move through the field produced by the wire to roller 10. The conductive particles 13 conduct negative ions to roller 10. Consequently, the conductive particles 13 fall off the surface or roller 10 or are thrown off roller 10 into bin 16. In contrast to the conductive particles 13, negative ions are believed to accumulate on the outer surface of each non-conductive particle 12 to cause each particle 12 to be attracted to the positively charged roller 10. The negatively charged non-conductive particles are scrapped off by scraper 43 into bin 15. Several disadvantages are associated with the apparatus of FIG. 1. First, the high voltage required to form a corona around wire 14 increases the risk of explosion or fire during the separation of particulate. Seconded, while the apparatus of FIG. 1 is well suited for the separation of conductive and non-conductive particles, it ordinarily is not believed well suited for separation of two types of conductive particles (for instance copper and silver particles) or for separation of two types of non-conductive particles (for instance rubber and paper particles).

Accordingly, it would be highly desirable to provide an improved particle separation apparatus and method which would significantly minimize the risk of fire or explosion and which could be utilized to separate dielectric particulate.

Therefore, it is a principal object of the invention to provide an improved method and apparatus for separating particles.

A further object of the invention is to provide an improved method and apparatus for separating dielectric particles.

Another object of the invention is to provide an improved particle separation method and apparatus which minimizes the utilization of energy at levels which increase the risk of fire.

Still a further object of the invention is to provide an improved particle separation method and apparatus which can distinguish between particles of differing size and tribolelectric propensity.

BRIEF DESCRIPTION OF THE SEVERAL VIEWS OF THE DRAWINGS

These and other, further and more specific objects an advantages of the invention will be apparent to those skilled in the art from the following detailed description thereof, taken in conjunction with the drawings, in which:

FIG. 1 is an elevation view illustrating a prior art particle separation apparatus;

FIG. 3 is an end view illustration a roller utilized in an alternate embodiment of the invention;

BRIEF SUMMARY OF THE INVENTION

Briefly, in accordance with my invention, I provide an improved method for separating particles. The method includes the steps of providing an article including a group of particles each having a selected weight and triboelectric propensity; electrically charging a surface to attract and hold particles in the particles in the group; contacting the surface with the particles in the group; and, neutralizing the electric charge on the surface such that the particles in the group can be removed from the surface.

In another embodiment of my invention, I provide an improved processing system including an article including a group of particles each having a selected weight and triboelectric propensity; apparatus for electrically charging the surface to attract and hold the particles in the group; apparatus for contacting the surface with the particles; and, apparatus for neutralizing the electric charge on the surface such that the particles can be removed from the surface.

In a further embodiment of my invention, I provide an improved processing system including a continuous belt; apparatus for moving the belt; at least one electrically chargeable surface connected to the belt; apparatus for electrically charging the surface to attract and hold particles each having a selected triboelectric propensity; and, means for neutralizing the electric charge on the surface.

DETAILED DESCRIPTION OF THE INVENTION

Figure 2:
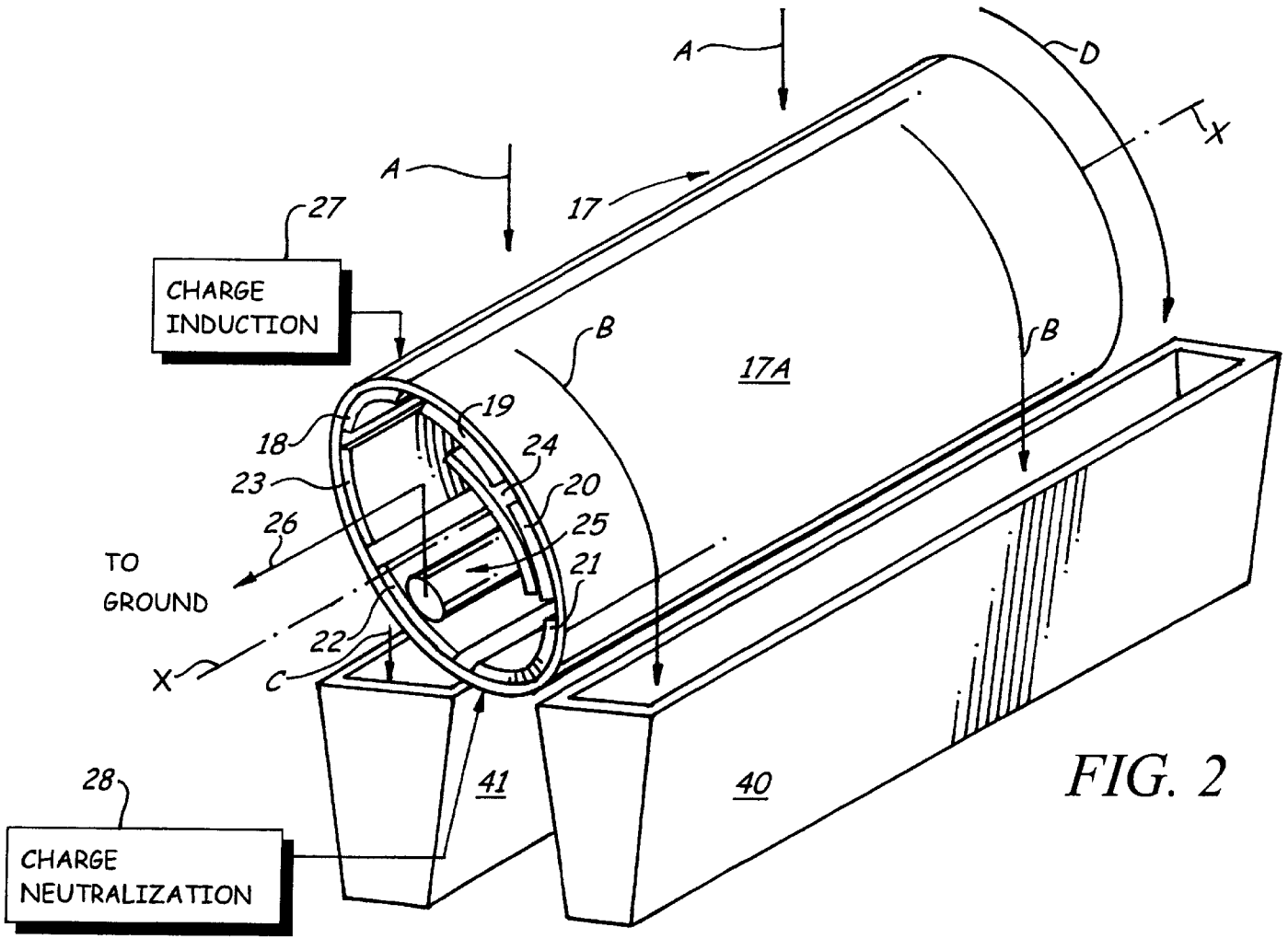
FIG. 2 is a perspective view illustrating particle separation apparatus constructed in accordance with the principles of the invention.

Turning now to the drawings, which describe the presently preferred embodiments for the purpose of illustrating the structure and use thereof and not by way of limitation of the scope of the invention, and in which like reference characters refer to corresponding elements throughout the several views, FIG. 2 illustrates a particle processing system which receives a stream of comingled particles falling under gravity as indicated by arrows A. The comingled particles include at least two separate groups of particles. The density, size, shape, electrical conductivity, modules of elasticity, color, weight, hardness, and other physical properties of each particle and/or group of particles can vary as desired; however, in the presently preferred embodiment of the invention, each group of particles consists of a dielectric. The first group of particles consists of generally spherical rubber particles having a maximum width in the range of about 1/32 to 1/8 of an inch. The second group of particles consists of nylon and/or rayon fibers or lint having a length in the range of about 1/64 to 1/4 of an inch and width in the range of about 1/128 to 1/32 of an inch. These comingled particles can be produced by grinding automobile and truck tires and using magnets and other filtering apparatus to remove metal cord from the ground material. Each fiber particle in the second group of particles weighs less than each rubber particle in the first group of particles and weighs less than 50%, preferably less than 30%, of the weight of each rubber particle in the first group of particles. The rubber particles comprise 97% to 98.5% of the comingled particles. The nylon and/or rayon fibers comprise 1.5% to 3% by weight of the comingled particles. The comingled particles typically sell at a price of about $40.00 to $70.00 a ton. If, however, the fibers can be separated from the comingled particles the price per ton of the rubber increases very significantly. New butyl rubber sell for about $2,000.00 a ton. If most of the nylon and/or rayon fibers can be removed so that the particle mixture is only 1/4% to 1/2% fibers and is 99.5 to 99.75% by weight rubber particles, then the price of the mixture typically increases from $40.00 to $70.00 per ton to $400.00 to $700.00 a ton. In addition, such a low fiber—particle mixture can be blended in with new rubber to make many products.

Nylon and rayon are each a dielectric. Table I provides the dielectric constant for each of a variety of common dielectrics.

TABLE I

Dielectric Constants for Common Materials

| Dielectric Constant | Material |
|---|---|
| 1.0 | Air |
| 25.0 | Ethyl alcohol |
| 2.5 | Transformer oil |
| 4.5 | Bakelite |
| 2.0 | Beeswax |
| 2.5 | Ebonite |
| 4.5–7.0 | Glass, various kinds |
| 6.0 | Mica |
| 4.1 | Micarta |
| 2.0 | Paper, dry |
| 2.3 | Paraffin |
| 4.0 | Plexiglas |
| 2.5 | Rubber, pure |
| 4.0 | Wood |
| 5.1 | Potassium Chloride |
| 2.7 | Asphalt |
| 4.0 | Iodine |
| 6.6 | Selenium |
| 6.32 | Corning 0010 |
| 3.8 | Silica Glass |
| 2.1 | Teflon |
| 3.8 | Quartz, fixed |
| 3.0 | Paper, Royal grey |
| 2.6 | Polystyrene |
| 5 to 7.5 | Fiber |
| 5 to 7.5 | Formica |
| 5.1 to 5.9 | Porcelain |

The triboelectric propensity of a material is the propensity of a first material to become positively charged (give up electrons to a second material) when the first material is rubbed with the second material. A first material has a greater triboelectric propensity than a second material if the first material gives up electrons to the second material when rubbed by the second material. For example, in Table II, nylon has a greater triboelectric propsensity than hard rubber, wood, silk, etc. Glass has a greater triboelectric propsensity than nylon.

TABLE II

Triboelectric Series

Any material in this table becomes positively charged (i.e., it gives up electrons) when the material is rubbed with any material lower on the list. The farther apart the materials are on the list, the higher the charge will be. Surface conditions and variation in characteristics of some material may alter some positions slightly.

Positive polarity (+)
Asbestos
Rabbit's fur
Glass
Mica Nylon
Wool
Cat's fur
Ca, Mg, Pb
Silk
Paper
Cotton
Wood
Lucite
Sealing wax
Cork, Ebony
Amber
Polystyrene
Polyethylene
Rubber balloon
Resins
Cu, Ni, Co, Ag, Sn, As, Bi, Sb, Pd, C, Brass
Para Rubber
Sulphur
Celluloid
Hard rubber
Vinylite
Saran wrap
Negative polarity (–)

The comingled particles fall onto rotating cylinder or drum 17. Drum 17 can be fabricated from any desired material but presently preferably is not a metal in order to minimize the likelihood that a spark may be generated which can cause a fire or explosion. Drum 17 is presently fabricated from a dielectric. Drum 17 is presently preferably PVC (polyvinyl chloride). Elongate generally rectangular metal plates 18 to 23 (presently aluminum) are conformed to and mounted on the inner surface of cylindrical drum in spaced apart parallel relationship. A motor or other means (not shown) are provided for rotating hollow drum 17 about centerline or axis X in the direction indicated by arrow D. Plates 18 to 23 are affixed to and rotate simultaneously with drum 17. A generally rectangular strip 24 of nylon carpet is mounted in a fixed position in which strip 24 is generally parallel to axis X and is positioned such that each metal strip 18 to 23 rubs against strip 24 as the metal strip rotates past strip 24 in the direction indicated by arrow D. When a metal strip 18 to 23 rubs against carpet strip 24, friction results which causes electrons to be transferred from stip 24 onto the strip 18 to 23, producing an electrical potential in strip 18 to 23 which is greater than zero volts and less than about five volts. When a strip 18 to 23 becomes negatively charged, the outer cylindrical surface 17A of drum 17 develops a negative charge. The negatively charged outer surface 17A more strongly attracts and holds the lighter, more triboelectrically sensitive fiber particles than the heavier, less triboelectrically sensitive rubber particles. Less dense particles also tend to be more effectively attached and held by charged surface 17A than more dense particles of the same size. Consequently, as drum 17 continues to rotate in the direction of arrow D, the heavier, denser, less triboelectrically sensitive rubber particles fall free form surface 17A under the force of gravity (and/or are thrown free) and travel into storage bin 40. In contrast, the lint particles continue to adhere to outer surface 17A until the metal plate 18 to 23 which is immediately beneath such adhering particles contacts metal roller 25. Roller 25 is, as indicated by arrow 26, connected to ground. When a plate 18 to 23 contacts roller 25, the negative charge in roller 25 is completely or substantial discharged, in which case the portion of outer surface 17A immediately above plate 18 to 23 loses most or all of its negative charge, permitting the fibers to fall in the direction of arrow C into bin 41. If desired, means (not shown) can also be provided to scrap off fiber particles in the manner shown in FIG. 1.

After a plate is discharged by contacting roller 25, the plate is again negatively charged when it rotates over carpet 24. This charge—discharge cycle continues for as long as drum 17 continues to rotate and intermittently contact a plate with carpet 24 and roller 25. Any means other than rug 24 can be utilized to generate a negative (or positive) charge on a plate 18 to 23 and/or the outer surface 17A.

One important advantage of the invention is the lower voltage required to generate a charge on the outer surface 17A.

Another advantage is the ability to position plates 18 to 23 inside drum 17 to reduce further the danger that a spark generated during the charging or discharge of a plate 18 to 23 could initiate an explosion or fire. As illustrated in FIG. 3, generally circular plates 29, 30 can be placed at either end of drum 17 to further enclose most of plates 18 to 23 and to enclose rug 24 and roller 25. If desired, a metal roller 31 can be provided which rolls over the end of each plate 18 to 23 as it passes by roller 31. Roller 31 is connected to ground to permit each plate 18 to 23 to discharge when it contacts roller 31. Roller 31 continuously rotates in the location shown in FIG. 3 and does not move about axis X with roller 17.

Still another advantage of the processing system of the invention is that it can be utilized to separate two groups of dielectric particles.

Yet another advantage of the processing system of the invention is that separation of two group of dielectric particles is often facilitated by allowing the particles to rub against one another prior to dispensing the particles in the direction of arrow A onto drum 17. Such rubbing of particles can be promoted by directing the particles over a vibrating table which permits the particles to bump and rub against each other while moving the particles to the edge of the table so they fall in the direction of arrows A onto drum 17. Since the fiber particles have a great triboelectric prospensity than the rubber particles, rubbing the fiber particles against the rubber particles tends to produce a positive surface charge on the fiber particles. Positively charging the fiber significantly improves the attraction between the negatively charged drum 17 and the fiber.

Figures 4, 5:
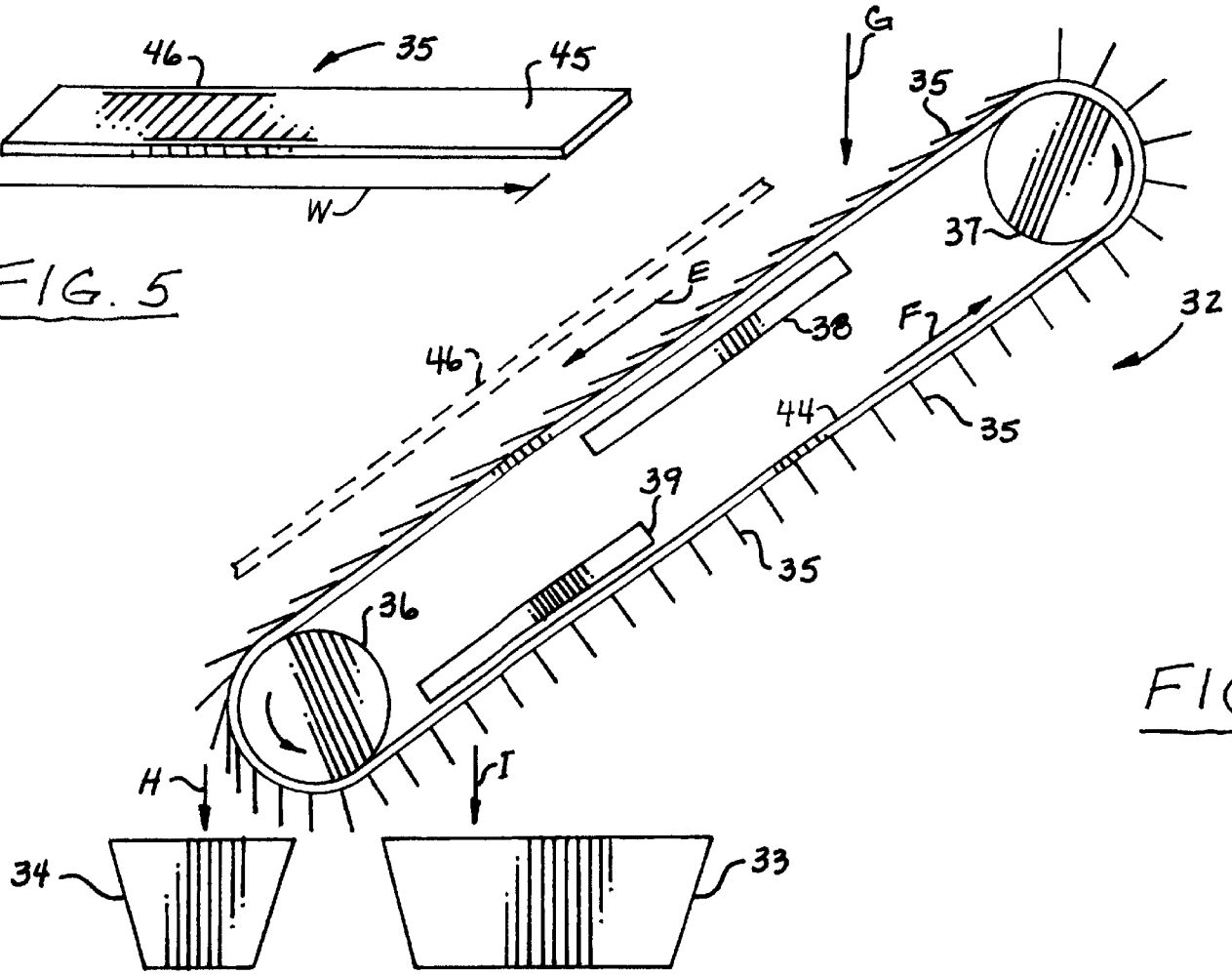
FIG. 4 is a side elevation view illustrating an alternate emobidment of the invention; and, FIG. 5 is a perspective view illustrating an electrically chargeable panel utilized in the apparatus of FIG. 4.

An alternate embodiment of the invention is illustrated in FIG. 4 and includes a continuous belt 44 mounted on driven rollers 36 and 37. Rollers 36 and 37 move belt 44 in the directions indicated by arrows E and F. A plurality of panels 35 are mounted on belt 44. Each panel 35 includes a rear elongate linear edge 46 which is pivotally attached to belt 44 in the manner described below. Each panel 35 also includes an outer surface 45 and can be electrically charged to attract particles having a selected triboelectric propensity. Panels 35 can be constructed in any desired manner as long as each panel 35 can be electrically charged to attract the desired particles. It is preferred that, as was the case of the embodiment of the invention illustrated in FIG. 2, the voltage utilized to create the electrical charge in each panel 35 and/or surface 45 be minimal. Charge induction means 38 is utilized to create an electric charge in each panel 35. The charge induction means 38 can comprise any desired means and is usually, but not necessarily, adjacent or contacting either belt 44 and panel 35. By way of example, the charge induction apparatus 24 utilized in FIG. 2 can be utilized to create a charge on panels 35.

The width of belt 44 can vary but presently is about equal to the width W of each panel 35. Belt 44 can comprise a continuous rubber strip, can comprise a pair of spaced apart parallel continuous chains each connected to one end of each panel 35, or can comprise any other structure for supporting and carrying panels 35 around rollers 36 and 37 in the manner illustrated in pan FIG. 4.

Charge neutralization means 39 are utilized to neutralize or remove the electrical charge from a panel 35. By way of example, the charge neutralization apparatus 25 utilized in the apparatus of FIG. 2 can be utilized as the charge neutralization means 39.

Panels 35 presently comprise thin metal slats, but can comprise a thin layer of metal (forming surface 45) on a rubber member or take on any desired shape and dimension and construction.

In operation of the apparatus of FIG. 4, comingled particles fall in the direction of arrow G onto the outer surfaces 45 of overlaid panels 35. In FIG. 4, overlaid panels 35 are shown spaced apart immediately beneath arrow G. This configuration is acceptable, but it is preferred that overlaid panels 35 contact each other as they pass beneath arrow G and over the charge inductions means 38. Charge induction means 38 produces an electrical potential in each panel 35 overlaid on belt 44 which is greater than zero volts and less than about five volts. The negatively charged outer surface 45 more strongly attracts and holds the lighter, more triboelectrically sensitive fiber particles than the heavier, less triboelectrically sensitive rubber particles. Less dense particles also tend to be more effectively attached and held by charged surface 45 than more dense particles of the same size. Consequently, as belt 44 continues to move in the direction of arrow E and down around roller 36, the heavier, denser, more triboelectrically sensitive rubber particles fall free from surfaces 45 under the force of gravity (and/or are thrown free) and travel downwardly in the direction of arrow H into storage bin 34. In contrast, the lint particles continue to adhere to outer surface 45 until the charge neutralization means 39 removes the negative charge from belt 44. When the negative charge in belt 44 is completely or substantially discharged, panels 35 each lose most or all of their negative charge, permitting the fiber particles to fall in the direction of arrow I into bin 33. If desired, means (not shown) can also be provided to scrap off fiber particles.

After belt 44 is discharged by charge neutralization means 39, contacting roller 25, the belt (and each panel 35) is again negatively charged when it passes by charge induction means 38. This charge—discharge cycle continues for as long as belt 44 is driven by roller 36 and/or 37 and moves in the directions indicated by arrows E and F.

When belt 44 moves down and around roller 36, the force of gravity causes overlaid panels 35 to spread or fall apart from and lose contact with one another in the manner shown. This falling apart functions to electrically disconnect each panel from the panels passing over induction means 38.

Each panel 35 is, as earlier noted, pivotally connected or hinged to belt 44 along the edge 46 of panel 35. This pivotal connection, however, only permits each panel 35 to open or fall a selected distance (i.e., so each panel 35 is normal to belt 44) so that after belt 44 moves up, over, and around roller 37, panels 35 will again fall and pivot under gravity into the overlaid configuration shown in FIG. 4 immediately beneath arrow G. However, the arrangement and mounting of panels 35 on belt 44 can vary as desired. Panels 35 need not overlie or contact each other when belt passes beneath arrow G and over induction means 38. Panels 35 may be mounted on the underside or inside of belt 44, much like strips 18 to 23 are mounted on the inside of cylinder 17A in FIG. 2. Panels 35 may not pivot and may each be attached to belt 44 in a permanent position spaced apart from other panels. Each panel can comprise a small metal dimple or area which is attached to the outer or inner surface of belt 44 and spaced apart from other dimples. And so on.

The apparatus of FIGS. 2 to 5 can, instead of being used to separate comingled particles, be utilized to remove particles from fabric or another article. For example, in FIG. 4, a strip of fabric 46 can be placed adacent to electrically charged panels 35 to pull lint or other particles from the strip of fabric 46 onto panels 35. Or, fabric strip 46 can move past panels 45 in the direction of arrow E or in a direction opposite that of arrow E. While fabric strip 46 moves past panels 35, particles can be pulled from strip 46 onto panels 35. The article placed adjacent or in contact with panels 35 or with the apparatus of FIG. 2 can be held stationary or can be moved in any desired manner to facilitate removal from the article to panels 35 of desired particles or of other objects of any shape and dimension.

Having described the invention in such terms as to enable those skilled in the art to understand and practice it, and having described the presently preferred embodiments thereof, I claim:

1. A method for separating a group of particles including a first group of particles having a triboelectric propensity, and a second group of particles having a triboelectric propensity less than the first group of particles, each particle in the second group having a weight greater than each particle in the first group, comprising the steps of (a) providing a processing system including (i) a surface movable between a first support position in which said surface supports particles on said surface and prevents particles from falling off said surface under the force of gravity, and a second position in which particles can fall off said surface under the force of gravity, (ii) charging means for electrically charging said surface with less than five volts of electricity to attract and hold said particles in said first group against said surface, (b) using said charging means to charge electrically said surface with less than five volts;

(c) dispensing said group of particles on said electrically charged surface when said surface is in said first position, the charge on said surface attracting particles in said first group to said surface; and, (d) moving said surface from said first support position to said second support position such that particles in said second group fall off said surface under gravity while said particles in said first group remain attracted to and in contact with said electrically charged surface.

2. A method for separating a group of particles including a first group of particles having a triboelectric propensity, and a second group of particles having a triboelectric propensity less than the first group of particles, the method comprising the steps of (a) providing a processing system including (i) a belt movable in a sloped orientation, and movable from said sloped orientation to a vertical orientation, said belt moving downwardly when in said sloped and vertical orientations, (ii) at least one chargeable outer surface on said moving belt, said outer surface supporting particles and preventing particles from falling off said surface under the force of gravity when said belt is in said sloped orientation, and permitting particles to fall off said surface under the force of gravity when said belt is in said vertical orientation, (iii) charging means for electrically charging said surface with less than five volts of electricity to attract and hold said particles in said first group against said surface to prevent said particles in said first group from falling off said surface under the force of gravity when said belt is in said vertical orientation;

(b) using said charging means to charge said surface with less than five volts;

(c) moving said belt in said sloped orientation;

(d) dispensing said group of particles on said surface when said belt is in said sloped orientation, the charge on said surface attracting particles in said first group to said surface; and, (e) moving said belt from said sloped orientation to said vertical orientation so that particles in said second group fall off said surface under the force of gravity while said particles in said first group remain attracted to and in contact with said electrically charged surface.

3. A method for separating a group of particles including a first group of particles having a triboelectric propensity, and a second group of particles having a triboelectric propensity less than the first group of particles, the method comprising the steps of (a) providing a processing system including (i) a belt movable in a first sloped orientation, movable from said first sloped orientation to a vertical orientation, said belt moving downwardly when in said first sloped orientation and in said vertical orientations, and movable from said vertical orientation to a second sloped orientation in which said belt moves upwardly, (ii) a plurality of panels each having an electrically chargeable outer surface and movably attached to said belt such that each of said panels is movable between at least first and second operative positions, when said belt is in said first sloped orientation said panels are in said first operative position and prevents particles from falling off said surfaces of said panels under the force of gravity, and When said belt is in said second sloped orientation said panels are in said second operative position and permit particles to fall off said surfaces of said panels under the force of gravity, (iii) charging means for electrically charging said surfaces of said panels to attract and hold said particles in said first group against said surfaces of said panels to prevent said particles in said first group from falling off said surfaces of said panels under the force of gravity when said belt is in said second sloped orientation;

(b) using said charging means to charge said surface of said panels;

(c) moving said belt in said first sloped orientation;

(d) dispensing said group of particles on said surfaces of said panels when said belt is in said first sloped orientation, the electrical charge on said surfaces of said panels attracting particles in said first group to said surfaces of said panels; and, (e) moving said belt from said first sloped orientation to said second sloped orientation so that particles in said second group fall off said surfaces of said panels under the force of gravity while said particles in said first group remain attracted to and in contact with said electrically charged surfaces of said panels.

* * * * *